US005706684A

United States Patent [19]

Gong et al.

[11] Patent Number: 5,706,684

[45] Date of Patent: Jan. 13, 1998

[54] METALWORKING PROCESS

[75] Inventors: Deli Gong, Cincinnati; Kevin H. Tucker, Blanchester, both of Ohio

[73] Assignee: Cincinnati Milacron Inc., Del.

[21] Appl. No.: 538,528

[22] Filed: Oct. 3, 1995

[51] Int. Cl.[6] ..... B21B 45/02

[52] U.S. Cl. ..... 72/42; 252/45

[58] Field of Search ..... 72/41, 39, 42; 252/45, 46.6, 47, 49.3

[56] References Cited

U.S. PATENT DOCUMENTS

| | | | |
|---|---|---|---|
| 3,833,502 | 9/1974 | Leary | 252/49.5 |
| 5,141,658 | 8/1992 | DiBiase | 252/49.3 |
| 5,286,300 | 2/1994 | Hnatin et al. | 252/49.3 |
| 5,368,758 | 11/1994 | Gapinski | 252/49.3 |
| 5,391,310 | 2/1995 | Krueger et al. | 252/45 |

*Primary Examiner*—Lowell A. Larson
*Assistant Examiner*—Rodney A. Butler
*Attorney, Agent, or Firm*—John W. Gregg; Donald Dunn

[57] ABSTRACT

There is provided a metalworking process, such as for example a punching process, wherein a shaping tool (eg. punch) contacts and applies a non-chip forming shaping force to a metallic workpiece (eg. blank) and there is supplied to the interface between the shaping tool and the metallic workpiece an aqueous fluid composition, having an alkaline pH, comprising water, a tall oil fatty acid, sulfurized lard oil, a sulfurized olefin, an oxyethylene/oxypropylene random or block copolymer diol having an average molecular weight in the range of from about 1000 to 8000 and an organic phosphate ester such as for example poly (1,2-ethanediyl) alpha-isodecyl-omega hydroxy phosphate. Reduced forces, lower friction and improved tool life are observed.

18 Claims, No Drawings

METALWORKING PROCESS

FIELD OF INVENTION

This invention relates to metalworking processes, more particularly heavy duty metalworking processes and even more particularly to heavy duty metalworking processes for forming metal objects without the production of the type of chips as are produced in metal cutting processes such as milling, turning, drilling, sawing and grinding. Further this invention relates to heavy duty metalworking processes employing a sulfurized aqueous metalworking fluid.

BACKGROUND

Heavy duty metalworking processes typically employ unusually high forces, generate high friction, produce high heat and use other severe conditions such as are generated in a high volume, high rate production operation for forming metal parts. These heavy duty metalworking processes usually are used to form metal parts by non-chip forming operations or by operations that do not produce the type of metal chips associated with metal cutting processes such as milling, turning, drilling, sawing and grinding. Such heavy duty metalworking operations may include for example punching, coining, wire drawing, spinning, stamping, rolling, ironing and forging. Heavy duty metalworking processes are hard on metalworking fluids used in such processes because of their severe conditions. Typically oil based metalworking fluids are employed in heavy duty metalworking processes. Water based fluids, on the other hand, have not enjoyed significant success in heavy duty metalworking processes because they have tended not to provide the stability and friction reduction properties to meet the severe operating conditions and extended tool life for such processes.

Oil (ie. non-aqueous) based fluids have long been known in the art for use in metalworking processes (ie. processes for mechanically shaping and working metals). Such fluids have exhibited good lubricating and limited cooling functions which reduce friction and dissipate heat in a metalworking process. This reduction of friction and dissipation of heat promotes long tool life, increases production and allows the attainment of high quality finished metal products. Many of the oil based metalworking fluids contain sulfurized and/or chlorinated oils to achieve effective friction reduction in the metalworking process. These sulfurized oils often have a high sulfur content and cause odor problems in metalworking operations, especially when sufficient heat is generated in the metalworking process. Notwithstanding the effectiveness of many oil based metalworking fluids such fluids exhibit, in addition to odor problems, disposal problems, health problems from vapors, safety problems, and costs which have led to the increased demand for the use of aqueous based metalworking fluids. Aqueous based metalworking fluids have been found to have fewer disposal, health, safety and availability problems than oil based metalworking fluids. Aqueous based metalworking fluids have excellent cooling function, low fire hazard, often easier disposal and many times lower cost characteristics compared to oil based metalworking fluids. In spite of these advantages aqueous based metalworking fluids have often exhibited lower performance (eg. lower friction reduction) than oil based metalworking fluids. This lower performance has resulted often in a reduction in productivity and tool life. Such reductions lead to high part cost.

Metalworking operations mechanically shape and work metallic workpieces by cutting and non-cutting processes.

The cutting processes include, for example, drilling, grinding, milling, tapping, turning and broaching. Non-cutting processes include, for example, rolling, drawing, extrusion, drawing and ironing, punching, stamping and spinning processes.

There has been and continues to be the need for improving the performance of heavy duty metalworking processes and the conditions under which such processes are carried out. In view of the safety, environmental and economic advantages of aqueous based metalworking fluids such fluids are potentially good candidates for improved heavy duty metalworking processes and overcoming the disadvantages of oil (ie. non-aqueous) based fluids.

It is therefore an object of this invention to provide an improved metalworking process, particularly an improved heavy duty metalworking process.

Another object of this invention is to provide a heavy duty metalworking process which avoids the disadvantages of prior art heavy duty metalworking processes.

SUMMARY OF INVENTION

These and other objects, as will be apparent to those skilled in the art from the following description, are achieved by the metalworking process of this invention. There is now provided in accordance with this invention a metalworking process comprising the step of contacting a metallic workpiece with a tool for mechanically shaping the workpiece in the presence of an aqueous fluid composition, having an alkaline pH, comprising water, a sulfurized oil having sulfur to sulfur bonds, an oxyethylene/oxypropylene block or random copolymer having at least one terminal hydroxyl group and an average molecular weight of from about 1000 to 8000 and a fatty acid having from 5 to 22 carbon atoms. In the context of this description and the appended claims and as used herein in relation to this invention the phrase metalworking process shall mean a process selected from the group consisting of punching, piercing, coining, swaging, spinning, stamping, rolling, wire drawing, extruding, drawing, ironing and forging processes. All of these processes are characterized as essentially non-chip forming metalworking processes. The metallic workpiece may, for example, include aluminum, iron, steel, stainless steel, rolled steel, copper, brass, titanium and various alloys of these metals.

DESCRIPTION OF INVENTION

There has now been discovered a metalworking process in accordance with this invention that overcomes many of the disadvantages, particularly safety (eg. fire, smoke and slippery conditions) and environmental (eg. odor, smoke and disposal) disadvantages, of comparable prior art metalworking processes employing straight oil (ie. non-aqueous) based metalworking fluid compositions. Additionally there has been discovered metalworking processes in accordance with this invention that have higher performance (eg. longer tool life) than comparable prior art processes using an aqueous based metalworking fluid. The performance of metalworking process in accordance with this invention is characterized by reduced shaping forces, reduced friction, reduced heat, improved tool life and increased productivity. Reduced shaping forces, reduced wear and reduced friction lead to increased tool life (ie. producing more parts with the tool before sharpening of the tool is required to continue producing acceptable quality parts) which means greater utilization of the tool between sharpenings, fewer sharpenings over a given time, lower down time for the process for tool changes, fewer tool changes to replace dull tools and their increased productivity. Reduced shaping forces and reduced friction also help in decreasing the production of scrap parts and increasing part quality. In the metalworking process in accordance with this invention a tool, for example a punching punch, a forming die, a roll, a stamping die, a swaging tool, a drawing die, an extrusion die and a piercing tool, is caused to contact and apply a mechanical shaping force to a metallic workpiece (eg. steel, aluminum, copper, brass etc.) to shape and sometimes pierce or shear the workpiece or a portion thereof (for example punching a hole in a workpiece). The tools in the processes in accordance with this invention vary in shape and construction, but all have the function of shaping a metallic workpiece. The metalworking process in accordance with this invention does not produce the chip normally produced in chip forming metalworking (ie. metal cutting) processes or operations such as for example milling, turning, drilling, tapping, broaching, sawing and grinding processes and thus does not include the chip producing metal cutting processes such as have been exemplified herein. Therefore the metalworking process in accordance with this invention is essentially a non-chip producing metal shaping process and thus does not include the chip producing metal cutting processes known in the art and processes such as have been exemplified herein. Typically the non-chip forming metalworking processes (er. punching, drawing, rolling etc.), are known in the art to employ higher shaping forces, and produce higher heat as compared to the chip forming metalworking processes in the absence of a metalworking fluid. Additionally the non-chip forming metal shaping processes typically have a greater surface area of contact between the tool and the metallic workpiece than the chip forming metal shaping processes. Thus the metalworking processes in accordance with this invention are, because of the severe conditions under which they operate compared to the metal cutting chip forming metal shaping processes, known as heavy duty metalworking processes. The terms metalworking and metal shaping as used herein shall have the same meaning and are employed herein interchangeably in respect to the heavy duty metalworking process of this invention.

This invention will now be described with reference to various embodiments and practices thereof. There is provided in accordance with the invention disclosed and claimed herein a metalworking process comprising the steps of contacting a metallic workpiece with a tool for mechanically shaping the workpiece with said tool, applying a mechanical force to the workpiece with the tool and supplying to the interface between the tool and the workpiece an aqueous fluid composition, having an alkaline pH, comprising water, at least 1.0% by weight, based on the total fluid, of a fatty acid (preferably a fatty acid having from 5 to 22 carbon atoms), a sulfurized oil having sulfur to sulfur bonds, at least 0.5% by weight, based on the total fluid, of an oxyethylene/oxypropylene random or block copolymer having at least one terminal hydroxyl group and an average molecular weight in the range of from about 1000 to 8000 and optionally an organic phosphate ester, wherein the aqueous fluid composition contains at least 0.4% by weight of chemically bound sulfur based on the total fluid. The fatty acid, sulfurized oil and optional phosphate ester should preferably be essentially water insoluble materials.

In accordance with one embodiment of this invention there is provided a punching process comprising the steps of contacting a metallic workpiece with a punching tool for mechanically shaping the workpiece, applying a mechanical force to the workpiece with the punching tool and supplying to the interface between the workpiece and punching tool an aqueous fluid composition, having an alkaline pH, comprising water, at least 1.0% by weight, based on the total fluid, of a fatty acid (preferably a fatty acid having from 5 to 22 carbon atoms), a sulfurized oil having sulfur to sulfur bonds, at least 0.5% by weight, based on the total fluid, of an oxyethylene/oxypropylene random or block copolymer having at least one terminal hydroxyl group and an average molecular weight of from about 1000 to 8000 and optionally an organic phosphate ester, wherein the aqueous fluid composition contains at least 0.4% by weight of chemically bound sulfur based on the total fluid. Preferably the fatty acid, the sulfurized oil and the phosphate ester should be essentially water insoluble materials.

In accordance with another embodiment of this invention there is provided a stamping process comprising the steps of contacting a metallic workpiece with a stamping tool for mechanically shaping the workpiece, applying a mechanical force to the workpiece with the stamping tool and supplying to the interface between the workpiece and stamping tool an aqueous fluid composition, having an alkaline pH, comprising water, at least 1.0% by weight, based on the total fluid, of a fatty acid (preferably a fatty acid having from 5 to 22 carbon atoms), a sulfurized oil having sulfur to sulfur bonds, at least 0.5% by weight, based on the total fluid, of an oxyethylene/oxypropylene block or random copolymer having at least one terminal hydroxyl group and an average molecular weight of from about 1000 to 8000 and optionally an organic phosphate ester, wherein the aqueous fluid composition contains at least 0.4% by weight of chemically bound sulfur based on total fluid. The fatty acid, sulfurized oil and optional phosphate ester should preferably be essentially water insoluble materials.

As a further embodiment of this invention there is provided a coining process comprising the steps of contacting a metallic workpiece with a coining tool for mechanically shaping the workpiece, applying a mechanical force to the workpiece with the coining tool, and supplying to the interface between the workpiece and the coining tool an aqueous fluid composition, having an alkaline pH, comprising water, at least 1.0% by weight, based on the total fluid, of a fatty acid (preferably a fatty acid having from 5 to 22 carbon atoms), a sulfurized oil having sulfur to sulfur bonds, at least 0.5% by weight, based on the total fluid; of an oxyethylene/oxypropylene block or random copolymer having at least one terminal hydroxyl group and an average molecular weight of from about 1000 to 8000 and optionally an organic phosphate ester, wherein the aqueous fluid composition contains at least 0.4% by weight of chemically bound sulfur based on the total fluid. Preferably the fatty acid, sulfurized oil and optional phosphate ester should be water insoluble materials.

As a still further embodiment of this invention there is provided a swaging process comprising the steps of contacting a metallic workpiece with a swaging tool for mechanically shaping the workpiece, applying a mechanical force to the workpiece with the swaging tool and supplying to the interface between the workpiece and the swaging tool an aqueous fluid composition, having an alkaline pH, comprising water, at least 1.0% by weight, based on the total fluid, of a fatty acid (preferably a fatty acid having from 5 to 22 carbon atoms), a sulfurized oil having sulfur to sulfur bonds, at least 0.5% by weight, based on the total fluid, of an oxyethylene/oxypropylene block or random copolymer having at least one terminal hydroxyl group and an average molecular weight of from about 1000 to 8000 and optionally an organic phosphate ester, wherein the aqueous fluid composition contains at least 0.4% by weight of chemically bound sulfur based on the total fluid. It is preferred that the fatty acid, sulfurized oil and optional phosphate ester should be essentially water insoluble materials.

In an even further embodiment of this invention there is provided a rolling process comprising the steps of contacting a metallic workpiece with a rolling tool to mechanically shape the workpiece, applying a mechanical force to the workpiece with the rolling tool and supplying to the interface between the workpiece and the rolling tool an aqueous fluid composition, having an alkaline pH, comprising water, at least 1.0% by weight, based on the total fluid, of a fatty acid (preferably a fatty acid having from 5 to 22 carbon atoms), a sulfurized oil, having sulfur to sulfur bonds, at least 0.5% by weight, based on the total fluid, of an oxyethylene/oxypropylene block or random copolymer having at least one terminal hydroxyl group and an average molecular weight of from about 1000 to 8000 and optionally an organic phosphate ester, wherein the aqueous fluid composition contains at least 0.4% by weight of chemically bound sulfur based on the total fluid. The fatty acid, sulfurized oil and optional phosphate ester should preferably be essentially water insoluble materials.

There is provided in accordance with an even further embodiment of this invention an extruding process comprising the steps of contacting a metallic workpiece with an extruding tool for mechanically shaping the workpiece, applying a mechanical force to the workpiece with the extruding tool and supplying to the interface between the workpiece and the extruding tool an aqueous fluid composition, having an alkaline pH, comprising water, at least 1.0% by weight, based on the total fluid, of a fatty acid (preferably a fatty acid having from 5 to 22 carbon atoms), a sulfurized oil having sulfur to sulfur bonds, at least 0.5% by weight, based on the total fluid, of an oxyethylene/oxypropylene block or random copolymer having at least one terminal hydroxyl group and an average molecular weight of from about 1000 to 8000 and optionally an organic phosphate ester, wherein the aqueous fluid composition contains at least 0.4% by weight of chemically bound sulfur based on the total fluid. Preferably the fatty acid, sulfurized oil and optional phosphate ester should be essentially water insoluble materials.

As a still further embodiment of this invention there is provided a drawing process comprising the steps of contacting a metallic workpiece with a drawing tool for mechanically shaping the workpiece, applying a mechanical force to the workpiece with the drawing tool and supplying to the interface between the workpiece and the drawing tool an aqueous fluid composition, having an alkaline pH, comprising water, at least 1.0% by weight, based on the total fluid, of a fatty acid (preferably a fatty acid having from 5 to 22 carbon atoms), a sulfurized oil having sulfur to sulfur bonds, at least 0.5% by weight, based on the total fluid, of an oxyethylene/oxypropylene block or random copolymer having at least one terminal hydroxyl group and an average molecular weight of from about 1000 to 8000 and optionally an organic phosphate ester, wherein the aqueous fluid composition contains at least 0.4% by weight of chemically bound sulfur based on the total fluid. Preferably the fatty acid, sulfurized oil and optional phosphate ester should be essentially water insoluble materials.

The aqueous fluid composition, having an alkaline pH, in accordance with the process of this invention comprises water, at least 1.0% by weight, based on the total fluid, of a fatty acid, a sulfurized oil having sulfur to sulfur bonds, at least 0.5% by weight, based on the total fluid, of an oxyethylene/oxypropylene block or random copolymer having at least one terminal hydroxyl group and an average molecular weight of from about 1000 to 8000 and optionally an organic phosphate ester, wherein the aqueous fluid composition contains at least 0.4% by weight of chemically bound sulfur based on the total fluid. Fatty acids usable in the practice of the aqueous fluid composition of the process of this invention include, but are not limited to, sorbic, oleic, linoleic, linolenic, eleostearic, licanic, ricinoleic, palmitoleic, petroselenic, vaccenic, erucic, stearolic, lauric, stearic, myristic and palmitic acids. Saturated and unsaturated fatty acids may be used. Fatty acids derived from animal and vegetable sources such as for example, lard, tall oil, coconut oil, rapeseed oil, sesame seed oil, palm kernel oil, palm oil, olive oil, corn oil, cottonseed oil, tallow, soybean oil, peanut oil, castor oil, seal oil, whale oil, and other fish oil may be used. Preferably the fatty acid will have from 5 to 22 carbon atoms. It is also preferred that the fatty acid be water insoluble.

Sulfurized oils usable in the practice of the aqueous fluid composition of the process of this invention may include but are not limited to sulfurized fats and sulfurized fatty oils, which may be of an animal or vegetable source, prepared by processes well known in the art. Examples of sulfurized fats and fatty oils include, but are not limited to, sulfurized tallow, sulfurized whale oil, sulfurized palm oil, sulfurized coconut oil, sulfurized lard oil, sulfurized castor oil and sulfurized rapeseed oil. Sulfurized fats and sulfurized fatty oils may be prepared, for example, by reacting a suitable sulfurizing agent (eg. sulfur, hydrogen sulfide, sulfur halide, sodium sulfide or sulfur dioxide) with the fat or fatty oil at elevated temperatures (eg. 50° to 350° C.) in the presence or absence of an inert solvent. The sulfurized fats and sulfurized fatty oil may contain, for example, from 2% to 45% by weight of sulfur. Sulfurized olefins and sulfurized mineral oil may be used as the sulfurized oil in the practice of this invention. Sulfurized olefins may include sulfurized polyolefins, particularly sulfurized low molecular weight polyolefins such as for example sulfurized ethylene and sulfurized low molecular weight polyethylene. The sulfurized olefins and sulfurized low molecular weight polyolefins may be prepared by processes well known in the art such as for example by reaction of sulfur or a sulfurizing agent (eg. hydrogen sulfide and sulfur dioxide) with an olefin at temperatures ranging from 100° to 350° C. in the presence or absence of a solvent medium and often in an inert atmosphere. Sulfurized olefins and sulfurized polyolefins having sulfur content in the range of from 5 to 45% by weight, preferable 30 to 45% by weight, may be used in the practice of this invention. Mixtures of sulfurized fats, mixtures of sulfurized fatty oils and mixtures of sulfurized olefins as well as mixtures of sulfurized fats and sulfurized fatty oil, mixtures of sulfurized fats and sulfurized olefins and mixtures of sulfurized fatty oils and sulfurized olefins may be used in the practice of this invention. It is to be noted that in accordance with this invention the sulfurized oil component of the aqueous fluid composition of the metalworking process has sulfur to sulfur bonds.

The oxyethylene/oxypropylene block or random copolymer having at least one terminal hydroxyl group and an average molecular weight of from about 1000 to 8000 has terminal hydroxyl groups attached to at least one end of the polymer. The oxyethylene/oxypropylene copolymer may be a random or block copolymer. For example, the copolymer may have a central polyoxypropylene moiety terminated on both ends with polyoxyethylene moieties or the copolymer may have a central moiety of a random or block copolymer of oxyethylene/oxypropylene terminated at both ends by a polyoxyethylene moiety. The copolymer may have terminal oxypropylene or oxyethylene moieties or one terminal oxypropylene and one terminal oxyethylene moiety. There may be used in the practice of the aqueous fluid composition of the metalworking process of this invention hydroxyl terminated oxyethylene/oxypropylene copolymers having an average molecular weight in the range of from 1000 to 8000, preferably 2500 to 6500. Methods well known in the art may be used to produce the hydroxyl terminated oxyethylene/oxypropylene copolymers usable in the practice of this invention. Examples of hydroxyl terminated oxyethylene/oxypropylene copolymers usable in the practice of this invention include, but are not limited to, commercially available hydroxyl terminated oxyethylene/oxypropylene copolymers known as Pluronic L 101 (average molecular weight of 3800, viscosity of 800 centipoies (cps) at 25° C.), Pluronic L 64 (average molecular weight of 2900, viscosity of 550 cps at 25° C.), Pluronic L 10 (average molecular weight of 3100, viscosity of 660 cps at 25° C.), Pluronic P 75 (average molecular weight of 4250, viscosity of 250 cps at 25° C.) and Pluronic 10 R8 (average molecular weight of 4500, viscosity of 420 cps at 25° C.), all of which are available from the BASF Corporation. Pluronic is a registered trademark of the BASF Corporation. It is preferred to employ in the aqueous fluid composition of the metalworking process invention disclosed and claimed herein as the hydroxyl terminated oxyethylene/oxypropylene copolymer an ethylene oxide terminated ethylene oxide/propylene oxide copolymer diol having an average molecular weight of about 4000.

There is optionally employed in the aqueous fluid of the process of this invention an organic phosphate ester, examples of which include, but are not limited to, poly (oxy-1,2-ethanediyl) alpha-isodecyl-omega hydroxy phosphate, alpha (p-nonylphenyl) omega hydroxypoly (oxyethylene) phosphate, mixture of alpha (p-nonylphenyl) omega hydroxy poly (oxyethylene) mono and dihydrogen phosphate esters, poly (oxy-1,2-ethanediyl) alpha (p-nonylphenyl) omega hydroxy phosphate. The organic phosphate ester may be prepared by processes known in the chemical arts, for example by esterifying with phosphoric acid a condensation product obtained by reacting an alcohol with an alkylene oxide. It is preferred in the practice of this invention to employ the organic phosphate ester in the aqueous fluid composition and that the organic phosphate ester be poly (oxy-1,2-ethanediyl) alpha-isodecyl-omega hydroxy phosphate. Although not required it is considered advantageous that the organic phosphate ester exhibit extreme pressure lubricating properties.

The concentrations of water, fatty acid, sulfurized oil, oxyethylene/oxypropylene block or random copolymers having at least one terminal hydroxyl group and an average molecular weight of from about 1000 to 8000 and optional organic phosphate ester in the aqueous fluid composition in accordance with the process of this invention may vary over a wide range. There may be employed, based on the total weight of the aqueous fluid composition, from about 0.5% to 98.0% by weight water, from about 0.5% to 80% by weight fatty acid, from about 0.5% to 75% by weight sulfurized oil, from about 0.5% to 20% by weight oxyethylene/oxypropylene block or random copolymer having at least one terminal hydroxyl group and an average molecular weight of from about 1000 to 8000 and from about 0.5% to 20% by weight organic phosphate ester. The specific amounts or ranges of amounts of each of these five components will vary with their chemical composition, their physical properties, combinations made and the metalworking process conditions in which the aqueous fluid composition is used, as is a well known practice in the art.

There may be added to the aqueous fluid composition of this invention, in conventional amounts, well known in the art, various additives such as for example corrosion inhibitors, biocides, fungicides, bactericides, surfactants, antioxidants, antifoamers and metal particle precipitating agents well known in the art.

Aqueous fluid compositions in accordance with the metalworking process of this invention may be prepared by methods well known in the art employing apparatus well known in and for preparing metalworking fluids. Essentially the aqueous fluid composition may be prepared by individually adding and blending together the components of the fluid, typically by adding each of the organic components separately to the water. However, it is also known to physically combine two or more of the organic components and then adding the combination to the water or composition being prepared. This approach may also be used to prepare the aqueous fluid composition of the metalworking process in accordance with this invention.

It is common practice in the art to prepare and ship aqueous fluid compositions (eg. aqueous metalworking fluid compositions) in a concentrated form. Such concentrated form may be then diluted with water to a use concentration by the end user (ie. the user of the fluid) and the diluted fluid employed in the metalworking operation. The concentrated form of the fluid usually contains a small amount of water, typically less than 10%. However larger amounts of water may be in the fluid composition prepared and shipped, which may then be diluted further with water to produce an end use concentration for the fluid. The advantage to preparing and shipping the concentrated form of the aqueous fluid is that it avoids sending large quantities of water from the producer of the fluid to the user of the fluid since the user can economically add water to the fluid to obtain the desired use concentration. Thus preparing and shipping the concentrated form of the aqueous fluid composition provides an economic advantage over preparing and shipping the fluid in an end use concentration. In the context of this description and the appended claims it is intended and shall be understood that the aqueous fluid composition in accordance with the process of this invention shall be the end use form (ie. the concentrations of components in the fluid) of the fluid as it is used in the process of this invention.

The metalworking process in accordance with this invention may involve or employ additional steps (ie. steps in addition to the disclosed and claimed steps of the process) to the required disclosed and claimed steps of contacting a metallic workpiece with a tool for mechanically shaping the workpiece, applying a mechanical force to said workpiece with the tool and supplying to the interface between the workpiece and the tool the aqueous fluid composition disclosed and claimed herein. Such additional steps which are not recited but which are well known to one skilled in the art are embraced within the scope of the metalworking process disclosed and claimed herein. The aqueous fluid composition in accordance with the metalworking process of this invention may be supplied to the interface between the tool and the workpiece by any of several methods well known in the art such as for example by spraying, by stream, by flooding, by immersion and by precoating the workpiece prior to the required steps of the metalworking process disclosed and claimed herein.

In the context of the metalworking process invention disclosed and claimed herein the phrase mechanical shaping shall mean shaping a metallic workpiece by applying a physical force to the workpiece by means of a solid object or tool so as to shape or alter the shape of the workpiece, the word tool shall mean a shaped solid object contacting and applying a shaping force to the workpiece and the phrase mechanical force shall mean the physical force applied by the tool to the metallic workpiece.

A laboratory simulated metalworking process simulating a metalworking process of a type within the scope of this disclosed and claimed invention has been carried out using a Tinius Olsen Ductomatic Sheet Metal Tester Model A 12, available from the Tinius Olsen Testing Machine Company, and the Deep Draw Cup Test described in Section V of the Instruction Manual IB #70-6 published June 1970 by the Tinius Olsen Testing Machine Company in conjunction with the AEG Flat Bottom Cup tooling, described in the Instruction Manual, and ACT cold rolled 1008 carbon steel having a thickness of 0.82 millimeters (mm.). A blank diameter of 73 mm., punch diameter of 33 mm., and a draw ratio of 2.2 were used. The metalworking process simulated in the laboratory with the Tinius Olsen Ductomatic Sheet Metal Tester Model A 12 is a deep draw process for creating cup shaped metal articles. In this laboratory simulated deep draw process a metal blank is held (ie. clamped) in place over a cup shaped die and a cup forming punch is brought into contact with and pressed against the blank to force the metal of the blank into the die to form a cup shaped metal object. This forming process was repeated on successively new blanks with increased clamping force applied to each new blank until failure (ie. rupture of the metal during the forming of the cup shape) was obtained. The clamping force on the blank when failure occurs was observed and recorded. A lubricating fluid was applied to both surfaces of each blank by brushing prior to carrying out the cup forming process. The higher the clamping force that can be applied to the blank before failure (ie. rupture) occurs during the cup forming operation the greater is the lubricity (ie. capacity to reduce friction and forces) of the lubricating fluid. Thus the higher the lubricity of the lubricating fluid the better is the fluid and the greater is the capacity for the process employing such fluid to exhibit reduced tool wear and greater tool life.

The following fluid compositions were used in the above described and referenced laboratory simulated metalworking process.

Fluid Composition No. 1

Tuf-Draw 43250E—a straight oil (non-aqueous) composition containing 30% chlorine available from the Franklin Oil Corporation. Tuf-Draw is a registered trademark of the Franklin Oil Corporation.

Fluid Composition No. 2

| Component | % by weight |
|---|---|
| Water | 23.8 |
| EO/PO polymer (1) | 5.4 |
| Tall oil fatty acid | 16.6 |
| 1,2-Dodecanedioic acid | 3.6 |
| Polyglycol ester (2) | 8.3 |
| Sorbitan monolaurate | 2.1 |
| Triethanolamine | 20.8 |
| 2-Amino-2-methyl-1-propanol | 1.5 |
| Sulfurized olefin (38.7% S) | 10.0 |
| Chlorinated olefin (3) | 4.0 |

Fluid Composition No. 3

| Component | % by weight |
|---|---|
| Water | 11.5 |
| Tall oil fatty acid | 21.0 |
| Sulfurized olefin (38.7% S) | 17.5 |
| Sulfurized fat (4) | 8.5 |
| Carbamate biocide | 0.5 |
| EO/PO polymer (1) | 9.5 |
| Disodium-2,5-dimercapto-1,3,4-thiadiazole | 3.5 |
| Sodium/triethanolamine salt of an alkenyl succinic acid | 4.0 |
| morpholine biocide | 0.5 |
| carbamate biocide | 0.3 |
| polyoxalkylene/organosiloxane mixture antifoamer | 0.1 |
| vanilla odorant | 0.1 |
| 2-Amino-2-methyl-1-propanol | 3.0 |
| Triethanolamine | 20.0 |

Fluid Composition No. 4

| Component | % by weight |
|---|---|
| Water | 9.0 |
| Tall oil fatty acid | 21.0 |
| Sulfurized olefin (38.7% S) | 17.5 |
| Sulfurized fat (4) | 8.5 |
| Phosphate ester (5) | 2.5 |
| carbamate biocide | 0.5 |
| EO/PO polymer (1) | 9.5 |
| Disodium-2,5-dimercapto-1,3,4-thiadiazole | 3.5 |
| Sodium/triethanolamine salt of an alkenyl succinic acid | 4.0 |
| morpholine biocide | 0.5 |
| carbamate biocide | 0.3 |
| polyoxyalkylene/organosiloxane mixture antifoamer | 0.1 |
| vanilla odorant | 0.1 |
| Triethanolamine | 20.0 |

(1) an ethylene oxide terminated ethylene oxide/propylene oxide copolymer diol having an average molecular weight of 3800, a cloud point (1% aqueous solution) of 15° C and a viscosity of 800 centipoises @ 25° C.
(2) a fatty acid ester of a 400 molecular weight polyethylene glycol, having a viscosity of 1200–1400 SUS at 100° F., an acid value of 74 and a specific gravity of 0.95
(3) chlorinated olefin having 60% chlorine
(4) Sulfurized lard oil
(5) a poly (oxy-1,2-ethanediyl) alpha-isodecyl-omega-hydroxyl-phosphate Fluid Composition Nos. 2, 3 and 4 were diluted with water at 30% fluid composition 70% water by weight prior to being used in the above described laboratory simulated metalworking process. Fluid Composition No. 1 was used as is (ie. without any dilution). The following results were obtained

| Fluid Composition No. | Critical Hold Down Force (lbs) |
|---|---|
| 1 | 2400 |
| 2 | 1800 |
| 3 | 2400 |
| 4 | >3000 |

It is readily seen from these results that the laboratory simulated metalworking process employing Fluid Compositions No. 3 and No. 4 (compositions according to the metalworking process of the invention disclosed and claimed herein) gave equal or superior results (2400 lbs. and >3000 lbs. respectively) compared to the laboratory simulated metalworking process using Fluid Composition No. 1, a straight oil (2400 lbs.) and the laboratory simulated metalworking process using Fluid Composition No. 2, an aqueous fluid composition not in accordance with the aqueous fluid composition of the metalworking process disclosed and claimed herein, (1800 lbs.).

A heavy duty commercial punch/pierce operation metalworking process experiment within the metalworking process scope of this invention was carried out using Fluid Composition Nos. 1, 2 and 4 described above. Fluid Composition No. 1 was used as is. Fluid Composition Nos. 2 and 4 were diluted with water at 30% Fluid Composition to 70% water by weight. In the punch/pierce operation 8 holes were simultaneously punched in an 11 millimeter (mm.) thick 1060 high carbon steel flange part using 8 punches in a hydraulic press. The hole size ranged from 12.5 mm. for 5 holes to 16.5 mm. for 2 holes and 21.0 mm. for 1 hole. The fluid compositions were sprayed onto the punches during the punch/pierce operation. The following results were obtained

| Fluid Composition No. | Number of hits* |
|---|---|
| 1 | 10,000 |
| 2 | 2500–3500 |
| 4 | >12,000** |

*number of hits before sharpening of the punches was needed.
**the punch/pierce operation was continuing satisfactorily to produce acceptable quality parts (ie. holes).

In the punch/pierce operation using Fluid Composition No. 4 smoke and odor problems, as encountered with the punch/pierce operation using Fluid Composition No. 1, were not observed. It is to be observed that the number of hits obtained in the punch pierce operation with Fluid Composition No. 4, before sharpening of the punch tooling was needed is far greater than that for the punch/pierce operation with Fluid Composition Nos. 1 and 2. This result shows that greater tool life was obtained in the punch/pierce metalworking process in accordance with the invention disclosed and claimed herein, than was obtained with the punch/pierce operation employing Fluid Composition Nos. 1 and 2.

In the preferred practice of the invention disclosed and claimed herein the metalworking process is a punching process, the fatty acid is a tall oil fatty acid, the sulfurized oil is sulfurized lard oil and a sulfurized olefin having 38.7% sulfur, the oxyethylene/oxypropylene block or random copolymer having at least one terminal hydroxyl group and an average molecular weight of from about 1000 to 8000 is an ethylene oxide terminated ethylene oxide/propylene oxide copolymer diol having an average molecular weight of 3800 and the organic phosphate ester is a poly(oxy-1,2-ethanediyl) alpha-isodecyl-omega-hydroxyl-, phosphate type phosphate ester.

Various embodiments of this invention have been disclosed herein. However, other embodiments of this invention may be recognized from this description by one skilled in the art. It is intended that the claimed invention herein shall include and embrace such other embodiments.

What is claimed is:

1. A metalworking process comprising the steps of contacting a metallic workpiece with a tool for mechanically shaping the workpiece, applying a mechanical force to the workpiece with said tool and supplying to the interface between the workpiece and the tool an aqueous fluid composition, having an alkaline pH, comprising water, at least 1.0% by weight, based on the total fluid, of a fatty acid, a sulfurized oil having sulfur to sulfur bonds, at least 0.5% by weight, based on the total fluid, of an oxyethylene/oxypropylene block or random copolymer having at least one terminal hydroxyl group and an average molecular weight of from about 1000 to 8000 and poly(oxy-1,2-ethanediyl) alpha-isodecyl-omega hydroxy phosphate wherein the aqueous fluid composition contains at least 0.4% by weight of chemically bound sulfur based on the total fluid.

2. The process of claim 1 wherein said process is a punching process.

3. The process of claim 1 wherein said process is a drawing process.

4. The process of claim 1 wherein said process is an ironing process.

5. The process of claim 1 wherein said process is a stamping process.

6. A process according to claim 1 wherein said process is a rolling process.

7. A process according to claim 1 wherein said process is a coining process.

8. A process according to claim 1 wherein said process is a piercing process.

9. The process according to claim 1 wherein the fatty acid is a $C_5$ to $C_{22}$ fatty acid.

10. The process according to claim 1 wherein the sulfurized oil is a sulfurized olefin.

11. A process according to claim 1 wherein the sulfurized oil is a sulfurized fat.

12. A process according to claim 1 wherein the copolymer has an average molecular weight in the range of 2500 to 6500.

13. The process according to claim 1 wherein said process is a combined punching and piercing process.

14. The process according to claim 1 comprising the step of spraying said aqueous fluid composition onto said tool.

15. The process according to claim 1 wherein said process is a punch/pierce process.

16. The process according to claim 2 wherein the fatty acid is a $C_5$ to $C_{22}$ fatty acid, the sulfurized oil is a sulfurized fat and a sulfurized olefin, the copolymer is a diol and has an average molecular weight of 3800 and the organic phosphate ester is poly (oxy-1,2-ethanediyl) alpha-isodecyl-omega hydroxy phosphate.

17. The process according to claim 2 wherein said copolymer is a diol and has an average molecular weight in the range of from 1000 to 8000.

18. The process according to claim 17 wherein said copolymer has an average molecular weight in the range of from 2500 to 6500.

* * * * *